US007666045B2

(12) United States Patent
Nigel

(10) Patent No.: US 7,666,045 B2
(45) Date of Patent: Feb. 23, 2010

(54) BUOYANT DEVICE

(75) Inventor: Axford Nigel, Sherbone (GB)

(73) Assignee: Thales Holding UK PLC (GB)

( * ) Notice: Subject to any disclaimer, the term of this patent is extended or adjusted under 35 U.S.C. 154(b) by 0 days.

(21) Appl. No.: 11/570,233

(22) PCT Filed: Jun. 2, 2005

(86) PCT No.: PCT/EP2005/052548

§ 371 (c)(1),
(2), (4) Date: Dec. 24, 2007

(87) PCT Pub. No.: WO2005/120943

PCT Pub. Date: Dec. 22, 2005

(65) Prior Publication Data

US 2008/0132130 A1 Jun. 5, 2008

(30) Foreign Application Priority Data

Jun. 7, 2004 (GB) ..... 0412678.5

(51) Int. Cl.
*B63B 22/18* (2006.01)

(52) U.S. Cl. ..... 441/22; 114/244; 114/253

(58) Field of Classification Search ..... 114/244, 114/245, 253, 305, 254; 441/22; 367/4, 367/153, 173

See application file for complete search history.

(56) References Cited

U.S. PATENT DOCUMENTS

| | | | | |
|---|---|---|---|---|
| 2,586,828 | A * | 2/1952 | Keeran | 441/22 |
| 3,380,424 | A | 4/1968 | Bowker et al. | |
| 3,940,813 | A | 3/1976 | Konstantinov et al. | |
| 4,298,964 | A * | 11/1981 | Warnshuis et al. | 367/4 |
| 4,947,782 | A | 8/1990 | Takahashi et al. | |
| 5,319,376 | A | 6/1994 | Eninger et al. | |
| 6,230,840 | B1 | 5/2001 | Ambs | |

FOREIGN PATENT DOCUMENTS

| | | |
|---|---|---|
| FR | 2 354 920 A | 1/1978 |
| FR | 2 465 603 A | 3/1981 |
| GB | 2 244 249 A | 11/1991 |

* cited by examiner

*Primary Examiner*—Lars A Olson
(74) *Attorney, Agent, or Firm*—Lowe Hauptman Ham & Berner, LLP

(57) ABSTRACT

A buoyant device has a body and an elongate tail. The body carries a payload. The tail is moveable, e.g. by pivoting, between a closed and an open position. This movement changes the position of the center of mass of the device relative to the center of buoyancy. As a result the device can move through the water, with the tail in the closed position, with minimal drag. However, when the tail moves to the open position, the body pivots in the water so that the body, and hence the payload is supported in a stable manner.

20 Claims, 3 Drawing Sheets

BUOYANT DEVICE

CROSS-REFERENCE TO RELATED APPLICATIONS

The present application is based on International Application No. PCT/EP2005/052548, filed on Jun. 2, 2005, which in turn corresponds to United Kingdom Application No. 04 12678.5, filed Jun. 7, 2004, and priority is hereby claimed under 35 USC §119 based on these applications. Each of these applications are hereby incorporated by reference in their entirety into the present application.

BACKGROUND OF THE INVENTION

Field of the Invention

The present invention relates to a buoyant device, i.e. a body which will float in water in the absence of external force. It is particularly, but not exclusively, concerned with a buoyant device in the form of a buoy which can be towed behind a marine vessel, particularly an underwater vessel, and which contains sensing/communications equipment.

Submarines and other underwater vehicles may operate both at the surface of water and submerged at depth. During operation, such vehicles need to be able to carry out sensing/communications, both when they are situated at the surface and at any depth at which the vehicle may be operating.

Effective sensing/communication of this nature when a submarine, for example, is at the surface does not pose any problems specific to underwater vehicles. However, such sensing/communication once the submarine is at depth is problematic, if not impossible. Thus, there is a requirement for a submarine or other underwater vehicle to be provided with the capability of carrying out above-water sensing/communications when the vehicle is itself at depth.

It is known to provide a device that floats at the surface of water and is capable of carrying communications equipment. However, there are known problems associated with the use of such apparatus. The problem generally lies in the proximity of the sensing/communications equipment to the surface of the water and the extent to which the equipment is maintained in an appropriate position for operation.

It would, of course, be possible to increase the size of the body, but this means that there will be greater resistance when the body is towed e.g. behind a submarine.

Therefore, at its most general, the present invention proposes that the device has at least two parts such that one part can be moved relative to the other to move the center of buoyancy of the device relative to the center of mass.

This way, by moving the parts of the device, the device may change the orientation that it adopts when floating. It may float in one orientation when the parts are in one position, to enable it to be towed efficiently, and then adopt a different orientation when the parts are in a different position, e.g. so that it floats with a part of the device held at a height above the surface of the water.

This enables the two conflicting requirements of the device to be met. The change in the position of the parts of the device, and the consequent movement of the center of buoyancy relative to the center of mass means that the device can be towed in a relatively compact state, and may then deploy for sensing/communications. This enables the body to operate even when it is being towed by a vessel which is submerged. The device can be allowed to float to the surface, due to its buoyancy, and then its orientation changed so that a part is lifted above the surface of the water, enabling sensing/communications on the raised part of the body with that raised part being clear of the surface of the water. The change in orientation of the parts of the device may be accompanied by changes in one or more dimensions of the device, so that the device may easily be stowed when not in use.

Accordingly, the present invention may provide a submersible device comprising a body and a tail moveable relative to the body, the body carrying a payload and the body being such that the device is buoyant, wherein the tail is moveable relative to the body between a closed position and an open position, the position of the center of mass of the device relative to the position of the center of buoyancy of the device being different in the closed and open positions.

SUMMARY OF THE INVENTION

Thus, the present invention may provide a device that can be deployed from a submerged vehicle to the surface of the water and caused to raise a payload, such as communications equipment, for example transmitters, receivers and/or sensors, above the surface of the water with sufficient height and stability to allow effective operation of the equipment.

The device with the tail in the closed position allows efficient travel through the water with minimal drag during deployment and recovery. The device may be in the submersible (folded) form when travelling to the surface to then be actuated to open at the surface, or -deployment may initiate unfolding to the extended (unfolded) form, such that the device rises to, and arrives at, the surface in the extended position. The closed position of the tail further ensures that the device has a low profile at the surface of the water. Additionally, with the tail in this position the device does not generate a visible wake at the start of its recovery from the surface to the submerged vehicle, reducing the likelihood of its detection. Furthermore, the device with the tail in the closed position can be stowed efficiently on the underwater vehicle. Whilst the center of mass of the device with the tail in the closed position when at the surface is vertically separated from its center of buoyancy, both centers are aligned both axially and laterally such that the device is stable in the water.

The device with the tail in the open position stably supports the sensing/communications payload at a sufficient height above the surface of the water so as to allow effective and reliable operation of equipment contained in the payload. In particular, the device with the tail in the open position will float with a different orientation from that when the tail is in the closed position. Thus, change from the closed to the open position lifts different parts of the body clear of the surface of the water, rotating the device through approximately 90°.

Transformation of the device from the relatively more compact form with the tail in the closed position to the relatively more elongate form with the tail in the open position effects the increase in height of the payload above the surface of the water. Furthermore, this transformation affects an increase in the vertical distance between the center of mass and the center of buoyancy of the device when at the surface of the water, which has the effect of increasing the stability of the device in the water. This additionally contributes to the effective and reliable operation of equipment contained in the payload.

In a preferred embodiment, the body of the device is an elongate body. Preferably, the body is a sealed watertight body. The tail may also be elongate.

Preferably, movement of the tail relative to the body is such that the separation of the center of mass from the center of buoyancy in the direction of the axis of elongation is greater when the tail is in the open position relative to the separation when the tail is in the closed position. This results in the device having greater stability at the surface when the tail is in the open position.

Preferably, the payload carried by the body of the device has sensing/communications equipment. Thus, the payload is carried by the device in a watertight compartment such that it is protected from any damage that may result as a consequence of contact with water or in a water environment. Most preferably, the sensing/communications equipment is located at an end of the body in a direction opposite to that of the direction of movement of the center of mass relative to the center of buoyancy when the tail moves relative to the body. Thus, when the device has the tail in the open position, the sensing/communications equipment is held above the surface of the water with sufficient height to allow effective operation of the transmitter, receiver and/or sensor.

Preferably, the tail is pivotable about the body. In particular, the tail is pivotable relative to the body about a pivot point. Preferably, the pivot point is closer to one end of the body than the center of buoyancy of the device. More preferably, the pivot point is closer to, or at the end of, the body opposite to the end carrying the transmitter, receiver or sensor. Thus, movement of the tail relative to the body between the closed position and the open position has the effect of unfolding the device with the result of changing the shape and length of the device. Thus, the shape and length of the device with the tail in the open position is more elongate in the direction of the axis of elongation of the body relative to the closed position. This movement has the effect of increasing the distance between the center of mass and the center of buoyancy of the device. Thus, the body of the device when at the surface extends axially above the surface of the water. In doing so it raises the payload above the surface of the water. Conversely, the tail of the device extends axially down into the water.

The tail may contain ballast. Preferably, ballast is moveable along the length of the tail. More preferably, the ballast is reversibly moveable from a first position when the tail is in the closed position to a second position when the tail is in the open position. Thus, movement of the tail, with or without ballast, moves the center of mass of the device such that there is greater separation between the center of mass and the center of buoyancy of the device in the direction of the axis of elongation of the body. This has the effect of increasing the stability of the device with the tail in the open position when it is at the surface of the water.

Still other advantages of embodiments according to the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

In a preferred embodiment, the body of the device has a rotatable mainplane. More preferably, a pair of rotatable mainplanes are positioned on opposite sides of the body. The attitude of the mainplanes relative to the body of the device may be altered by rotating the mainplanes relative to the body. Thus, the longitudinal axis of a mainplane may be aligned with (i.e. substantially parallel to), or substantially perpendicular to, the direction of the axis of elongation of the body. The mainplanes contribute to the stability of the device. The mainplanes are preferably positioned with their longitudinal axes perpendicular to that of the axis of elongation of the body of the device with the tail in the open position at the surface in order to help damp heave of the device. Furthermore, the tail may comprise a tailplane and/or a tail fin. Similarly, these serve to contribute to the stability of the device at the surface. In particular, when the device has the tail in the open position, the tailplane and tail fin help to damp movement in both surface pitch and roll motion.

Preferably, the device has a towing attachment to allow the device to be tethered to and towed by an underwater vehicle such as a submarine. Preferably, the towing attachment is on the underside of the device relative to the surface of the water.

In another preferred embodiment, the device further comprises an extendible arm carrying a further payload. Preferably, the extendible arm is attached to the body of the device. Preferably, the arm carries the further sensing/communications payload such that extension of the arm from a first position to a second position extends the further payload in a direction opposite to that of the direction of movement of the center of mass relative to the center of buoyancy when the tail moves relative to the body. More preferably, the further payload is extended beyond the end of the body in a direction opposite to that of the direction of movement of the center of mass relative to the center of buoyancy when the tail moves relative to the body. Preferably, the extendible arm is pivotally attached to the device. Preferably, the extendible arm comprises a watertight part which contains the further payload. Preferably, the payload is positioned at the end of the extendible arm furthest away from the device when the arm is extended. Such an extendible arm allows a payload to be raised to a greater height above the surface of the water when the tail is in the open position. When the tail is in the closed position the size of the raised payload at height is reduced.

Preferably, the body and the tail of the device comprise a carbon composite. However, the device may comprise any material or combination of materials that combines minimal mass with maximal strength, such that the device can withstand depth and pressure cycling without buckling. Preferably, the material also provides good surface performance.

DETAILED DESCRIPTION OF THE EMBODIMENTS

Figure 1:
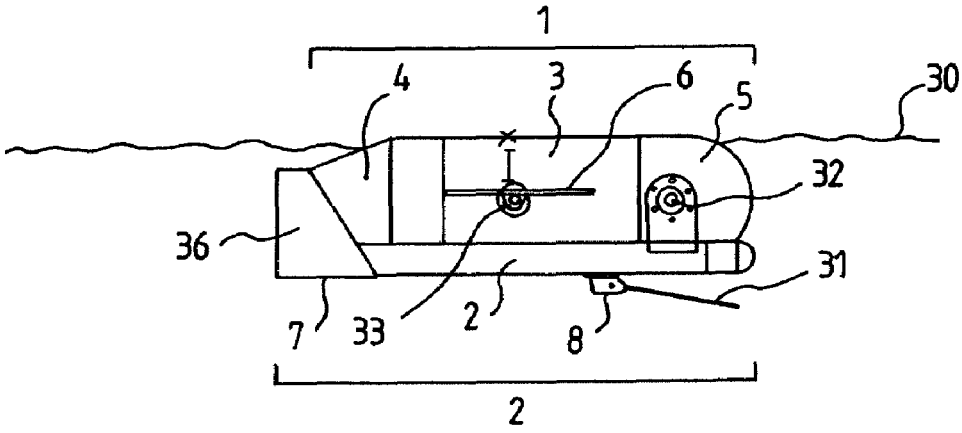
Figure 2:
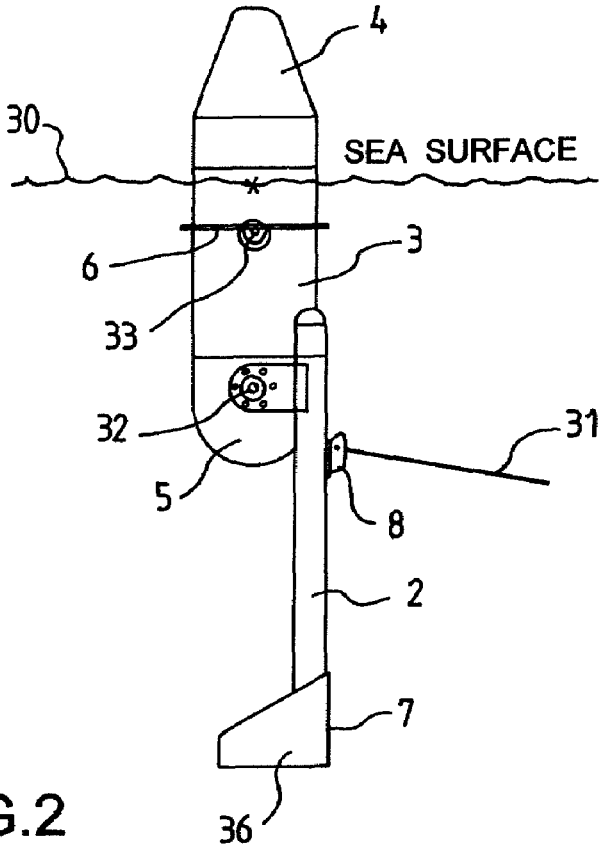
Figure 3:
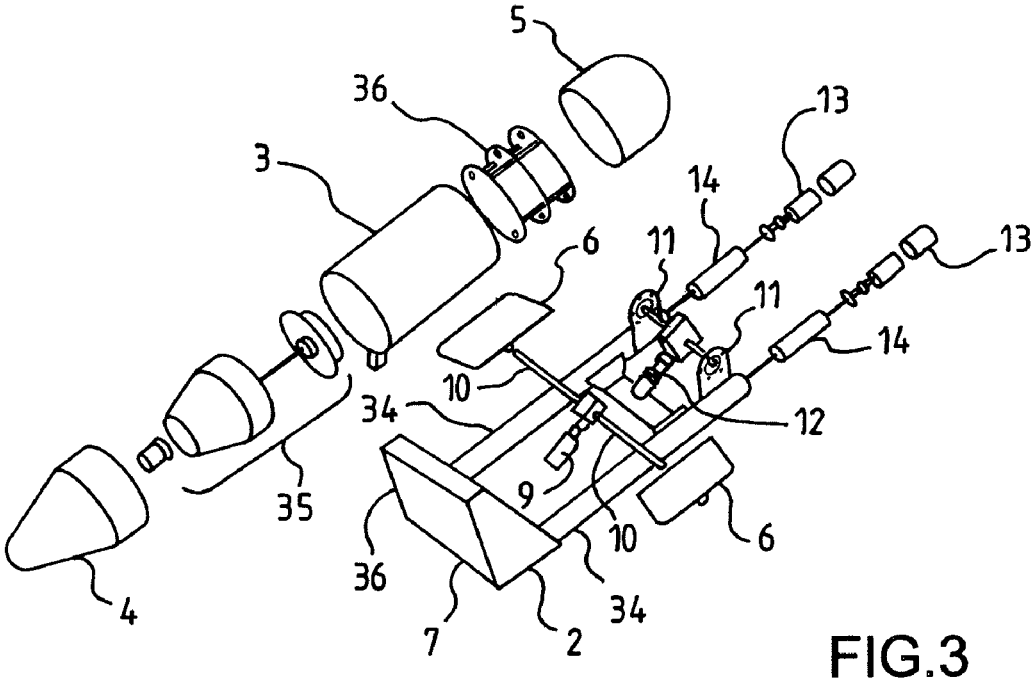
Figure 4:
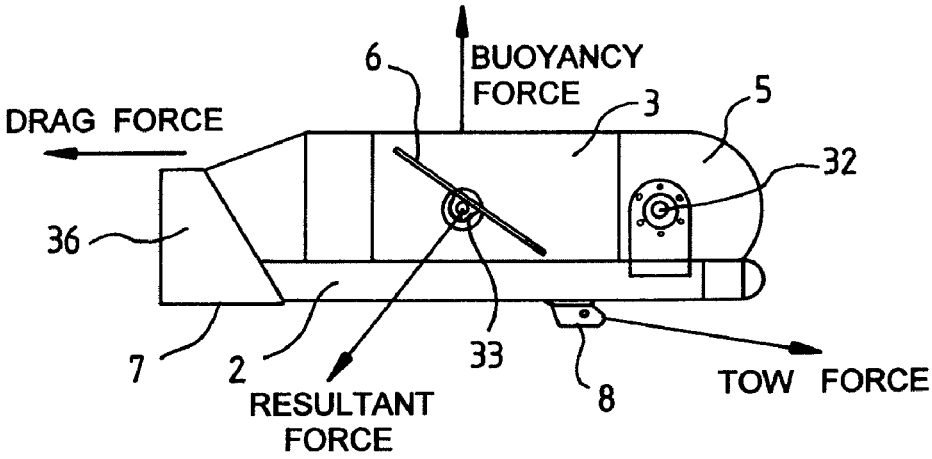
Figure 5:
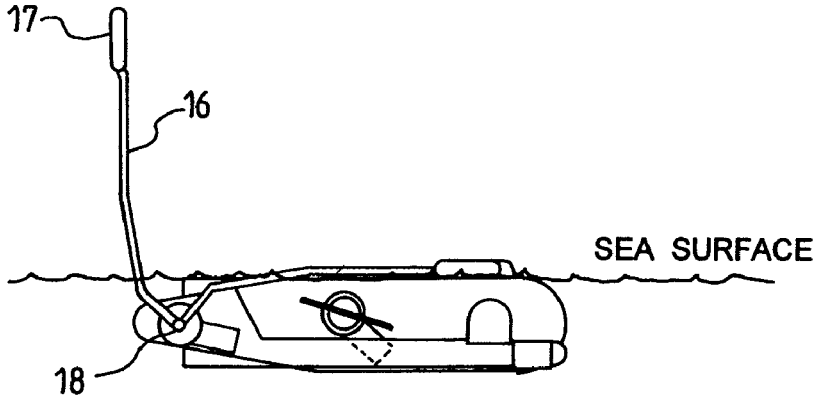
Figure 6:
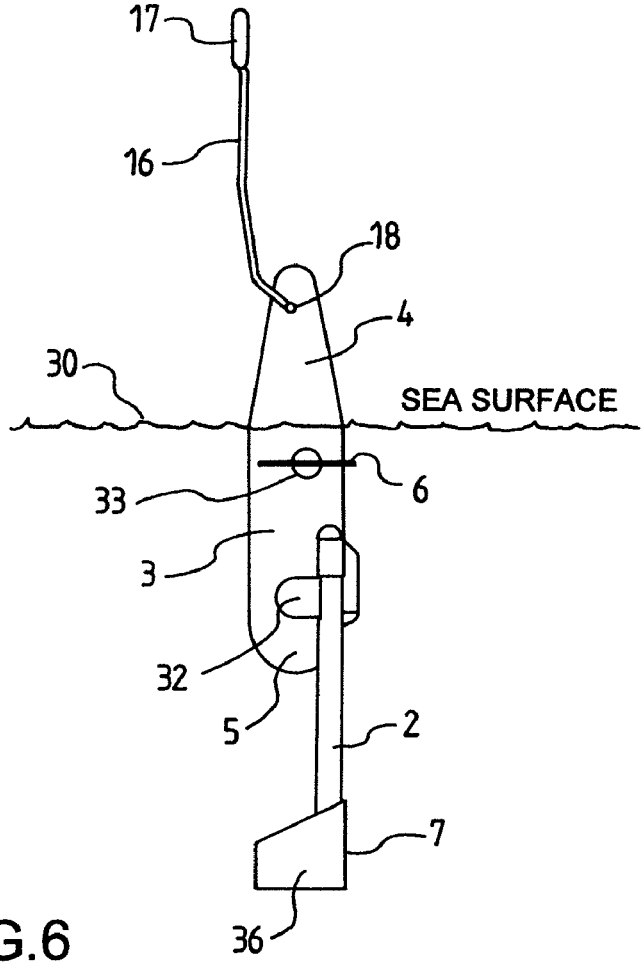

Embodiments of the invention will now be described in more detail, by way of example only, with reference to the accompanying drawings, in which FIG. 1 shows a schematic view of a first embodiment of the device according to the invention when the tail is in the closed position;

FIG. 2 shows a schematic view of the first embodiment of the device according to the invention when the tail is in the open position;

FIG. 3 shows an exploded schematic view of the first embodiment of the device according to the invention;

FIG. 4 shows a schematic view of the first embodiment of the device according to the invention when the tail is in the closed position before the device is recovered from the surface of the water;

FIGS. 5 and 6 show schematic views of a second embodiment of the device according to the invention when the tail is in the closed and open positions, respectively.

Two embodiments of a device according to the invention that can be deployed from a submerged vehicle to the surface of the water to allow effective operation of transmitters, receivers and/or sensors of the payload will now be described. The devices can be recovered to a submerged vehicle by means of a tether connecting the submerged vehicle and the device. The devices can also be stowed on a submerged vehicle.

FIGS. 1 and 2 show a device according to a first embodiment of the invention in the closed and open positions, respectively. The device is transformable between the closed and open states shown. Referring to FIGS. 1 and 2, a submersible device has an elongate body 1 and a similarly elongate tail 2. The body 1 is a sealed watertight compartment that carries the payload (not shown). The body 1 comprises a main body 3, a radome 4 and a tail gearbox compartment 5. The radome 4 contains part of the payload (not shown). As will be discussed later the payload may have communications equipment such as transmitters, receivers and/or sensors. For example, the payload may have above- and below-water sensors together with their electronics and power supplies. In this case, the transmitters, receivers and/or sensors are located in the radome 4. The radome 4 comprises a strong glass composite material which is almost transparent at the frequencies of operation. The radome 4 is connected to the main body 3 via a sealed joint. The main body 3 comprises a carbon composite giving as light a structure as possible. It is reinforced with rings to resist buckling at depth. A pair of mainplanes 6 are rotatably attached to the main body 3 at a position along the length of the body 1 corresponding to the center of mass and center of buoyancy of the device with the tail in the closed position. The main body 3 houses other parts of the payload, for example, the electronics and power supplies of the transmitters, receivers and/or sensors, fitted on panels that assist in reinforcing the body when fitted. The opposite end of the main body 3 to the radome 4 is connected to the tail gearbox compartment 5. This also comprises a carbon composite for minimum weight. The tail 2 is connected to the tail gearbox compartment 5 and comprises a pair of booms. At the opposite end to the connection to the gearbox compartment 5, the tail has a tailplane 7. A towing point 8 is attached to the tail 2 to allow the device to be tethered via a tether line 31 to an underwater vehicle such as a submarine.

As indicated in FIG. 1, the device has the tail in the closed position at the surface of the water. The axis of elongation of the body 1 of the device is essentially parallel to the surface 30 of the water. The tail 2 lies folded directly over the body 1 so that the body 1 substantially overlays the tail 2 such that the axis of elongation of the body 1 is substantially parallel to the axis of elongation of the tail 2. The mainplanes 6 are positioned in a horizontal attitude when the device is at the surface, essentially parallel to the surface of the water.

FIGS. 1 and 2 also show that the tail 2 is connected to the body 3 via a pivot 32, which pivot 32 connects to components within the tail gear box compartment 5 as will be described later. Similarly, the mainplanes 6 are connected to the main part 3 of the body 1 via pivots 33. These enable the mainplanes to be turned between the position shown in FIGS. 1 and 2 respectively.

As indicated in FIG. 2, the device has the tail in the open position at the surface of the water such that the axis of elongation of the body 1 is substantially parallel to the axis of elongation of the tail 2, but the body 1 does not substantially overlay the tail 2. The axis of elongation of the body 1 of the device is essentially perpendicular to the surface of the water. Thus, the body 1 extends axially away from the tail 2 such that the radome 4 carrying the payload extends above the surface 30 of the water. Thus, in this position the transmitters, receivers and/or sensors, contained in the radome 4, are held above the surface 30 of the water. The mainplanes 6 lie just beneath the surface of the water and are positioned in a horizontal attitude, parallel to the surface of the water and perpendicular to the axis of elongation of the body 1, such that they can damp heave. The tail 2 extends axially away from the body 1 down into the water. The tailplane 7 serves to damp both surface pitch and roll movement.

FIG. 3 is an exploded view of the device showing the internal components of the device. The main body 3 has two bearing housings within its skin (not indicated) at the pivot points for actuation of the mainplanes 6. The housings are sited at the center of mass and center of buoyancy along the axis of elongation of the device when the device has the tail 2 in the closed position. Each housing accommodates bearings and double sealing for the rotating shaft mainplane actuation system 9. The mainplane actuation system 9 is driven by an electric motor through two gearboxes (not indicated) and out through the skin of the main body 3 to the mainplanes 6 via mainplane drive shaft 10. Thus, the mainplane drive shaft 10 rotates about its position at the center of mass and center of buoyancy along the axis of elongation of the device in the closed position to rotate the mainplanes 6 through a range of maximum efficiency. The normal loading on the mainplanes 6 either side of the drive shaft 10 are equal. The mainplanes 6 are sited on the drive shaft 10 such that the loads are transferred directly onto the shaft.

The tail gearbox compartment 5 contains two bearing/seal housings (not indicated) for a tail drive shaft 11 to effect folding of the tail 2. The housings are integral with the tail gearbox compartment 5 skin and accommodate the drive shaft bearings and double shaft seals for the tail fold actuation system 12. The tail fold actuation system 12 is driven by an electric motor through gearboxes (not indicated) and out through the skin of the tail gearbox compartment 5 to the twin booms of the tail 2 via tail drive shafts 11. The tail drive shafts 11 are hollow and dry and incorporate penetrators into the body 1 of the device from the tail 2 pivotally connecting the tail 2 to the body 1 at the pivot points 32. The penetrators are fitted into the ends of the tail drive shaft 11. Cable entering the body will have sufficient spiral slack to accommodate rotation of the body/tail.

The tail 2, which has twin booms 34, comprises the tail drive shaft 11, ballast weights 14, ballast drive motors 13, stabilizing vertical fins 36 and a horizontal tailplane 7. Actuation of the tail causes the whole tail assembly to pivot about its connection to the body 1, such that the tail assembly rotates about the tail drive shaft (11,) to allow transformation between the closed state of the device and the open state of the device where the tail is in the closed and open positions, respectively. The ballast weights 14 are positioned inside the boom of the tail 2. The ballast weight motors 13 adjacent these moving end of the tail 2 to the horizontal tail plane. One assembly of ballast weight 14 and its motor 13 is confined within each of the boom tubes. Actuating lead screws 15 run between the ballast weight 14 and the motor 13 of each assembly to allow movement of the ballast weight 14 along the length of the tail 2.

The towing point 8 of the device is positioned centrally between the two tail booms 2 e.g. on a cross-beam (not indicated). The longitudinal position of the cross-beam is governed by its interface with a docking mechanism on the underwater vehicle and the clearance needed between the tail 2 and the tail gearbox compartment 5 as the tail 2 unfolds. The towing point 8 allows the device to be towed at high speed.

FIG. 3 also shows the device has a sensor package 35 which fits in the radome 4, and an electronics package 36 which fits in the main body.

The submersible device with the tail in the folded closed position fits within a small stowage on a submarine or other underwater vehicle. When required to be used it is released from stowage and actuated to unfold. Actuation initiates unfolding of the device such that the tail unfolds from the folded closed position to the unfolded open position. The tail 2 pivots about the body 1 at the point of connection until the tail 2 reaches the position where the axis of elongation of the body 1 is substantially parallel to the axis of elongation of the tail 2 but the body 1 does not substantially overlay the tail 2. Thus, actuation causes the tail 2 to rotate approximately 180° about the tail drive shaft 11. At the same time the ballast weights 14 extend along the lead screws 15 in the tail booms towards the tailplane 7 end of the tail 2 by means of the ballast motors 13. Furthermore, the mainplanes 6 align horizontally along the axis of elongation of the body 1 of the device. These actions ensure that the device rises to the surface at high velocity. As the device nears the surface, the mainplanes 6 rotate about the mainplane drive shaft 10 to retard the device prior to breaching. The device with the tail in the open position at the surface thus raises the payload stably above the surface of the water. Alternatively the unfolding sequence can be initiated at the surface with a resulting limited rise velocity.

Prior to recovery, the device is actuated to fold, converting it from having the tail in the open position back into the closed positions to balance the forces on the device in its horizontal attitude. Thus, actuation causes the ballast weights 14 to move back in the reverse direction along the tail boom tubes to their original positions. At the same time, the mainplanes 6 rotate to align horizontally along the axis of elongation of the body 1 of the device. The tail 2 rotates back into the folded closed position lying underneath the body 1.

As shown in FIG. 4, once the device has refolded into the closed state and is ready to be recovered from the surface, the mainplanes 6 are rotated out of the horizontal attitude to the dive position. The ballast weights 14 may additionally be used to trim the device slightly nose down whilst at the surface to aid the initial recovery process.

As indicated in FIG. 4, a towing force is then applied to the towing point 8 via a tether. The resultant force produced on the mainplanes 6 overcomes the buoyancy force and the device becomes submerged. The mainplanes 6 are controlled throughout recovery of the device to regulate the depth and rate of descent until it reaches its docking mechanism on the underwater vehicle. The mainplanes 6 are generally aligned with the axis of elongation of the device prior to stowage to reduce the space needed for stowage.

FIGS. 5 and 6 show a second embodiment according to the invention. Many features of the second embodiment are similar to those of the first embodiment, and the same reference numerals are used to indicate corresponding parts.

However, in the second embodiment, the device further comprises an extendible arm 16 carrying a further payload 17. The further payload 17 may have further transmitters, receivers and/or sensors. The extendible arm 16 is pivotally connected to the body 1 of the device at a position 18 on the radome 4. As shown in FIG. 5, when not in use, the longitudinal axis of the arm 16 is substantially parallel to the axis of elongation of the body 1. Extension of the arm 16 from this position extends the further payload 17 in a direction opposite to that of the direction of movement of the center of mass relative to the center of buoyancy when the tail 2 moves relative to the body 1. Extension of the arm 16 in this way is affected by the arm 16 pivoting about the connection 18 to the body 1. FIG. 5 shows the arm 16 in use when the device has the tail in the closed position at the surface. Thus, the further payload 17 is held above the surface of the water. FIG. 6 shows the arm 16 in use when the device has the tail in the open position at the surface. Thus, the payload 17 is extended beyond the end of the body 1 in a direction opposite to that of the direction of movement of the center of mass relative to the center of buoyancy when the tail moves relative to the body, high above the surface of the water.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. A towed buoyant device, comprising:

a body and a tail moveable relative to the body, the body carrying a payload and the body being such that the device is buoyant, wherein the tail arranged on the body is rotatable relative to the body between a closed, folded position and an open, unfolded position allowing the deployment of the device, the rotation of the tail from the closed position to the open position causes a center of mass and a center of buoyancy of the device being moved away from one another, and the distance between the two centers in the direction of the axis of elongation causes the body and the tail adopting a vertical position.

2. The device according to claim 1, comprising a pivot point about which the tail is pivotable relative to the body, said pivot point being arranged on the body so as to be closer to one end of the body than to the center of buoyancy of the device.

3. The device according to claim 1, wherein the body is elongate.

4. The device according to claim 1, wherein the tall comprises moveable ballast.

5. The device according to claim 1, wherein the body has a rotatable mainplane.

6. The device according to claim 1, wherein the comprises a tailplane and/or a tail fin.

7. The device according to claim 1, wherein the device comprises a towing attachment.

8. The device according to claim 1, wherein the payload comprises a transmitter, a receiver or a sensor, located at an end of the body in a direction opposite to which the center of mass moves when the tail unfolds relative to the body.

9. The device according to claim 1, further comprising an extendible arm carrying a further payload such that extension of the arm from a first position to a second position extends the further payload in a direction opposite to that of the direction of movement of the center of mass relative to the centre of buoyancy when the tail moves relative to the body.

10. The device according to claim 9, wherein the further payload extends beyond the end of the body in a direction opposite to that of the direction of movement of the center of mass relative to the center of buoyancy when the tail moves relative to the body.

11. The device according claim 9, wherein the arm is pivotally connected to the body.

12. The device according to claim 10, wherein the arm is pivotally connected to the body.

13. The device of claim 8, further comprising an extendible arm carrying a further payload such that extension of the arm from a first position to a second position extends the further payload in a direction opposite to that of the direction of movement of the center of mass relative to the center of buoyancy when the tail moves relative to the body.

14. The device according to claim 13, wherein the further payload extends beyond the end of the body in a direction opposite to that of the direction of movement of the center of mass relative to the center of buoyancy when the tail moves relative to the body.

15. The device according to claim 13, wherein the arm is pivotally connected to the body.

16. The device according to claim 14, wherein the arm is pivotally connected to the body.

17. The device according to claim 1, wherein the body and the tail comprise a carbon composite.

18. The device according to claim 2, wherein the body and the tail comprise a carbon composite.

19. The device according to claim 3, comprising a pivot point about which the tail is pivotable relative to the body, said pivot point being arranged on the body so as to be closer to one end of the body than to the center of buoyancy of the device.

20. The device according to claim 4, comprising a pivot point about which the tail is pivotable relative to the body, said pivot point being arranged on the body so as to be closer to one end of the body than to the center of buoyancy of the device.

* * * * *